US005315078A

United States Patent [19]

Freymüller

[11] Patent Number: 5,315,078

[45] Date of Patent: May 24, 1994

[54] POLARITY SWITCH FOR STEP-TRANSFORMER SELECTOR

[75] Inventor: Heinrich Freymüller, Bruck, Fed. Rep. of Germany

[73] Assignee: Maschinenfabrik Reinhausen GmbH, Regensburg, Fed. Rep. of Germany

[21] Appl. No.: 989,343

[22] Filed: Dec. 11, 1992

[30] Foreign Application Priority Data

Dec. 13, 1991 [DE] Fed. Rep. of Germany ..... 4141142

[51] Int. Cl.[5] ..... H01H 9/00

[52] U.S. Cl. ..... 200/11 TC

[58] Field of Search ..... 200/8 R, 8 A, 11 K, 200/11 TC, 11 J

[56] References Cited

U.S. PATENT DOCUMENTS

| | | | |
|---|---|---|---|
| 4,207,445 | 6/1980 | Hammar | 200/11 TC |
| 4,935,586 | 6/1990 | Bleibtreu et al. | 200/11 TC |
| 5,107,200 | 4/1992 | Dohnal et al. | 200/11 TC X |
| 5,195,632 | 3/1993 | Lauterwald | 200/400 |

FOREIGN PATENT DOCUMENTS

| | | |
|---|---|---|
| 1103434 | 3/1961 | Fed. Rep. of Germany . |
| 1942567 | 7/1972 | Fed. Rep. of Germany . |
| 2548408 | 5/1979 | Fed. Rep. of Germany . |
| 2815736 | 9/1979 | Fed. Rep. of Germany . |
| 3719680 | 3/1991 | Fed. Rep. of Germany . |
| 2330131 | 5/1977 | France . |
| 2369670 | 5/1978 | France . |
| 2077503 | 12/1981 | United Kingdom . |

*Primary Examiner*—J. R. Scott
*Attorney, Agent, or Firm*—Herbert Dubno; Andrew Wilford

[57] ABSTRACT

A step-transformer selector has a generally cylindrical drum centered on an axis and provided with an annular array of selector contacts and, axially offset therefrom, with at least one polarity contact offset axially from the selector contacts. A selector shaft extends along the axis in the drum and rotatable about the axis to connect to selected ones of the selector contacts. A polarity switch having a pivot in the drum offset from the axis and a ring can rock in the drum on the pivot between a connecting position touching and connecting to the polarity contact and an out-of-service position offset from and out of contact with the polarity contact. A cam on the shaft engages a follower on the ring for rocking the ring from its out-of-service position into its connecting position at least once during each rotation of the shaft about the axis.

5 Claims, 2 Drawing Sheets

POLARITY SWITCH FOR STEP-TRANSFORMER SELECTOR

FIELD OF THE INVENTION

The present invention relates to a polarity switch for a step selector. More particularly this invention concerns such a switch used on a selector for a step transformer.

BACKGROUND OF THE INVENTION

The step selector for a step transformer comprises a cylindrical drum made of insulating material and normally centered on an upright axis. Mounted in the drum are annular arrays of contacts for preselecting, changeover, and fine selecting. Coaxial shafts extending along the axis in the drum carry arms having terminals that are brought into engagement with these contacts to select the desired transformer steps.

During switching by a coarse selector of changeover device the step windings of a step transformer are briefly separated galvanically from the main winding. During this time these windings develop voltages, induced from adjacent windings as well as capacitatively with respect to these windings and to ground. Since these voltages can become substantial, it is therefore standard to provide a system which can relieve them to avoid damage to the switching terminals and contacts.

This is done by a polarity switch which maintains the step windings at a predetermined potential by connecting them together through a resistance during the brief switchover time. Such a polarity switch is described in German patent 1,942,567 filed 21 Aug. 1969 by W. Weber et al and in German patent document 2,548,408 filed 23 Oct. 1975 by U. Schweitzer et al. It is coaxial with the preselecting and fine-selecting contact systems and below the step selector, substantially increasing the height of the system. In German patent 2,815,736 filed 12 Apr. 1978 by A. Bleibtreu et al the polarity switch is mounted on the side of the step-selector drum. This increases the width of the system and is fairly complex. Both systems require a separate drive for the polarity switch, increasing equipment costs and the possibility of parts failure.

Other systems are described in German patent document 1,103,434 filed 2 Mar. 1960 by O. Leopold and in German patent 3,719,680 filed with a claim to an Austrian priority date of 02 Jul. 1986 by H. Schmidt. These systems also are fairly bulky and entail substantial extra equipment.

OBJECTS OF THE INVENTION

It is therefore an object of the present invention to provide an improved polarity switch for a step-transformer selector.

Another object is the provision of such an improved polarity switch for a step-transformer selector which overcomes the above-given disadvantages, that is which is very simple and compact.

SUMMARY OF THE INVENTION

A step-transformer selector has a generally cylindrical drum centered on an axis and provided with an annular array of selector contacts and, axially offset therefrom, with at least one polarity contact offset. A selector shaft extending along the axis in the drum and rotates about the axis to connect to selected ones of the selector contacts. According to the invention a polarity switch having a pivot in the drum offset from the axis and a ring can rock in the drum on the pivot between a connecting position touching and connecting to the polarity contact and an out-of-service position offset from and out of contact with the polarity contact. A cam on the shaft engages a follower on the ring for rocking the ring from its out-of-service position into its connecting position at least once during each rotation of the shaft about the axis.

Thus with this system a very simple connection of the polarity ring with the shaft ensures movement of this polarity ring into contact normally with all of the polarity contacts. The system takes up no room outside the drum and is easily accommodate inside the drum between the different rings of contacts therein.

According to the invention the polarity contact is spring mounted, that is it can move horizontally against spring force so that when the ring engages it the respective spring holds the polarity contact in tight conducting contact with the ring. Alternately the polarity contact(s) can be fixed and the follower can be connected via some spring means, for instance a springy arm, to the ring to provide spring biasing of the ring into engagement with the polarity contact(s) in the contacting position.

In accordance with further features of the invention the pivot defines a pivot axis lying in a plane generally perpendicular to the drum axis and axially offset from the polarity contact. Furthermore the pivot is formed as an electrical contact connected to the ring and to the polarity contact in the connecting position only. The cam has a pair of at least partially nonparallel cam surfaces engaging the follower for different movement of the ring between its positions during forward and reverse rotation of the shaft carrying the cam.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
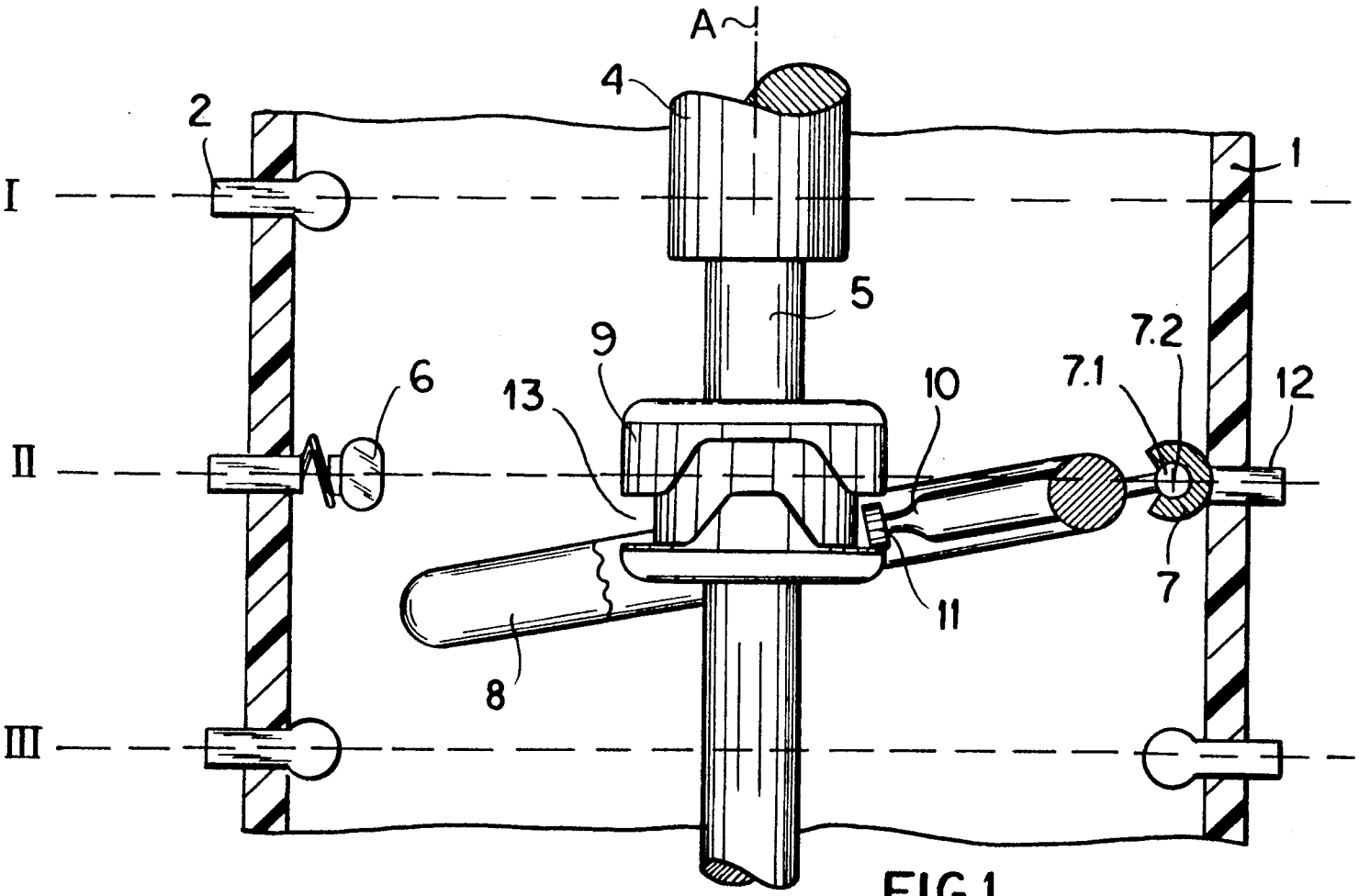
FIG. 1 is a mainly diagrammatic vertical section through the polarity switch of this invention.

As seen in FIG. 1 a selector drum 1 is made of an insulating material such as glass-fiber reinforced plastic and is centered on a vertical axis A. At an upper level I it is provided with preselector contacts 2 (only one shown) and at a lower level III with fine-selector contacts 3 that are engaged by respective unillustrated terminals carried on respective shafts 4 and 5 extending along the axis A. In an intermediate level II between the levels I and III are spring-loaded polarity contacts 6 (only one shown) that are connected to center taps of unillustrated windings. A maltese-wheel drive or other system such as described in commonly owned patent applications 07/783,629 now U.S. Pat. No. 5,195,632 and 07/925,979 now U.S. Pat. No. 5,266,759 respectively filed 25 Oct. 1991 and 05 Aug. 1992 is used to rotate these shafts 4 and 5 about the axis A in the manner well known in the art.

A pivot 7 is provided on a contact 12 located on the level II and connected back to the main winding as well known per se. A transverse bolt 7.1 on this pivot 7 defines an axis 7.2 lying in the plane II and carries a ring 8 that can rock from the illustrated out-of-service position to an upper connecting position engaging the contacts 6 and connecting same electrically to the terminal or contact 12 so as to prevent voltage buildups in the respective windings.

Figure 2A:
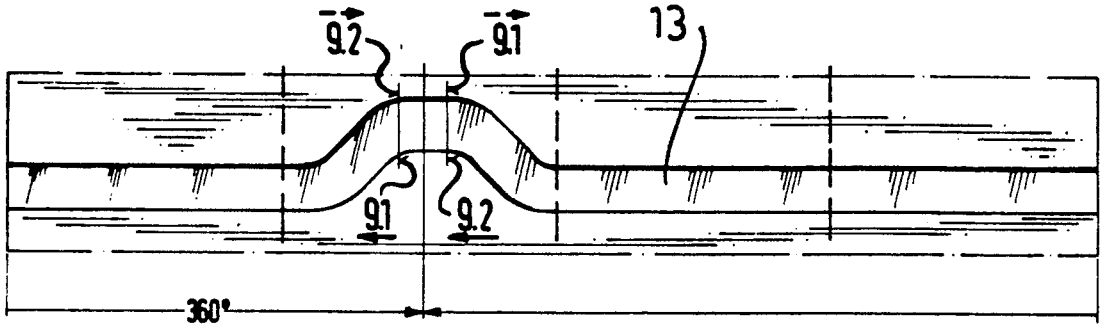
FIG. 2*a* is a developed view of the cam groove of FIG. 1.

A radially inwardly projecting arm 10 on the ring 8 has an inner end provided with a roller 11 engaging in a groove 13 of a cam 9 carried on the shaft 5. This cam groove 13 has as shown in FIG. 2*a* a single inflection location for the 2×360° rotation used in a fine selector. The groove 13 has switch-on points 9.1 and switch-off points 9.2. Thus once each revolution the ring 8 will be pivoted upward to contact the terminals 6 briefly, thereby discharging the respective windings. If the shaft 4 or 5 does not make a full 360° rotation, the cam inflection can be positioned nonetheless to drain the contacts 6 at the appropriate time during switchover.

Figure 2B:
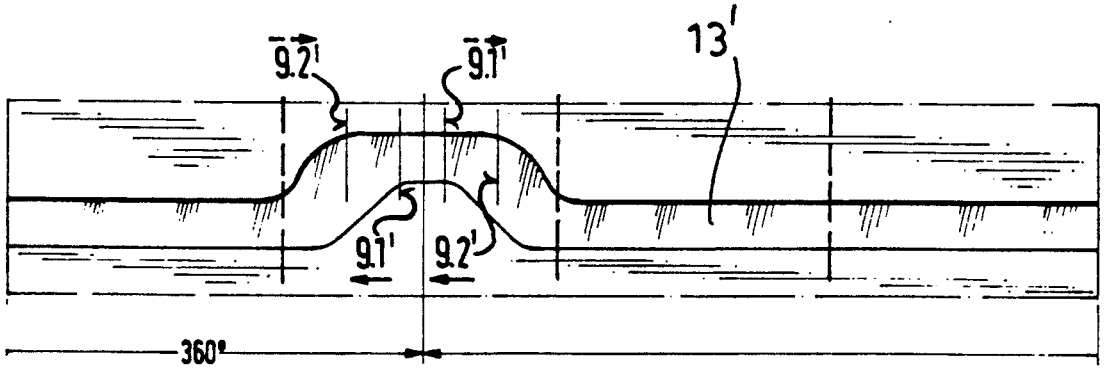
FIG. 2*b* is a view like FIG. 2*a* of a variant on the cam groove.

The angles of the sides of the inflection in the cam groove 13 determine how quickly the ring 8 is pivoted up and back. In FIG. 2*a* the action is symmetrical. In FIG. 2*b* a groove 13' is shown whose switch-on and switch-off points 9.1' and 9.2' will move the ring 8 differently depending on the direction of rotation of the cam 9. In such an arrangement, the ring 8 when in the contacting position is held by the spring contacts 6. To this end it is advantageous that the axis 7.2 is horizontally offset from the planes of the contacts 6 so that the ring 8 lies in the contacting positions on the upper ends of the contacts 6 and is held thereby. Thus to disconnect it is first necessary to overcome the spring force, that is to push the contacts 6 out against the force of their biasing springs. Alternately the arm 10 could be somewhat flexible or could have a spring connection at one of its ends so that fixed contacts 6 could be used and the springiness of the arm 10 would maintain the necessary contact force with the ring 8 lying on the undersides of the contacts 6 when contacting them.

The cam 9 is fixed to the shaft 5. The groove 13 could, however, be cut directly into the shaft 4 or 5 the cam could be otherwise constituted.

I claim:

1. In step-transformer selector comprising:

a generally cylindrical drum centered on an axis and provided with an annular array of selector contacts and with at least one polarity contact offset axially from the selector contacts; and a selector shaft extending along the drum axis in the drum and rotatable about the axis to connect to selected ones of the selector contacts;

a polarity switch comprising:

a pivot in the drum offset from the drum axis and defining a pivot axis offset from the drum axis;

a ring rockable in the drum on the pivot about the pivot axis between a connecting position touching and connecting to the polarity contact and an out-of-service position offset from and out of contact with the polarity contact;

a cam on the shaft having a cam surface; and means including a follower mounted on the ring and riding on the cam surface for rocking the ring from its out-of-service position into its connecting position at least once during each rotation of the shaft about the drum axis.

2. The polarity switch defined in claim 1 wherein the polarity contact is spring mounted.

3. The polarity switch defined in claim 1 wherein the pivot axis lies in a plane generally perpendicular to the drum axis and axially offset from the polarity contact.

4. The polarity switch defined in claim 1 wherein the pivot is formed as an electrical contact connected to the ring and to the polarity contact in the connecting position only.

5. The polarity switch defined in claim 1 wherein the cam has a pair of at least partially nonparallel cam surfaces engaging the follower.

* * * * *